United States Patent [19]

Ota et al.

[11] Patent Number: 4,639,292

[45] Date of Patent: Jan. 27, 1987

[54] DRYING CYLINDER FOR USE IN PAPER MAKING

[75] Inventors: Toyokazu Ota, Omihachiman; Yutaka Nakamura, Tomakomai, both of Japan

[73] Assignees: Oji Seisha Kabushiki Kaisha, Tokyo; Shikishima Casvas Kabushiki Kaisha, Osaka, both of Japan

[21] Appl. No.: 662,481

[22] Filed: Oct. 19, 1984

[30] Foreign Application Priority Data

Dec. 6, 1983 [JP] Japan ..... 58-189012

[51] Int. Cl.[4] ..... D21F 5/02

[52] U.S. Cl. ..... 162/375; 29/131; 29/132; 34/110; 34/124; 162/359; 165/89

[58] Field of Search ..... 29/110, 129.5, 131, 29/132; 156/215; 34/41, 110, 124; 165/89; 162/359, 375; 100/93 RP

[56] References Cited

U.S. PATENT DOCUMENTS

| | | | |
|---|---|---|---|
| 2,264,731 | 12/1941 | Wakem | 29/131 |
| 2,608,749 | 9/1952 | Obitz | 29/131 |
| 2,780,859 | 2/1957 | Kinzelman | 29/131 |
| 4,192,080 | 3/1980 | Irpola | 29/110 |

*Primary Examiner*—Peter Chin

*Attorney, Agent, or Firm*—Armstrong, Nikaido, Marmelstein & Kubovcik

[57] ABSTRACT

In order to control the moisture profile of paper webs in the cross machine direction thereof in the dryer part of the paper making process a built-up insulating sheet fixedly wound around a part of the circumferential surface of a drying cylinder is composed of a fluorine resin coated sheet having an adhesive agent coated layer on the reverse side thereof and an air-containing synthetic fabric adhered to said fluorine resin coated sheet and having a width slightly smaller than that of said fluorine resin coated sheet. The built-up insulating sheet is adhered to the circumferential surface of the drying cylinder at the appointed positions thereof through the adhesive agent coated layer exposed at the end portion of the fluorine resin coated sheet.

5 Claims, 5 Drawing Figures

DRYING CYLINDER FOR USE IN PAPER MAKING

BACKGROUND OF THE INVENTION

The present invention relates to a drying cylinder for use in paper making, and more particularly to a drying cylinder comprising a built-up insulating sheet fixedly wound around the circumferential surface of the drying cylinder at the appointed positions thereof in order to control the moisture profile of paper webs in the cross machine direction thereof in a paper making process.

In cases where wet paper web is subjected to a drying treatment in a multi-cylinder type drying machine for use in paper making, it is remarkably important to equalize the moisture profile of the paper web in the cross machine direction thereof. If the moisture profile of the paper web is not equalized in the cross machine direction thereof, drying streaks are produced on the final products which lead to the generation of various kinds of defect such as curling in following stage.

It is, however, considerably difficult from a practical point of view to equalize the moisture profile of paper web in the cross machine direction thereof on account of the defects produced in the preceding process and inevitable causes incidental to the drying process. Thus, a large number of technical means for improvements of a drying cylinder in heat-conducting structure and a dryer felt have been proposed and practiced in order to prevent wet paper web from being non-uniformly dried in the drying part of a paper making process. For example, the present applicant already proposed a technical means of remarkably reducing the fluctuation in the moisture profile of paper web in the cross machine direction thereof in comparison with known means for the prevention of non-uniform drying in U.S. patent application Ser. No. 622,483 filed Oct. 19, 1984 and titled "Method of controlling moisture profile in paper web in paper drying process and apparatus for practicing same". The preceding invention proposes a means for eliminating a non-uniform moisture profile in wet paper web, which is transferred into a drying part, in the cross machine direction thereof, in which synthetic fabrics containing air-holding portions therein are fixedly wound around the surface of a drying cylinder at the desired positions thereof to make the air-holding portions function as insulting layers and lower heat conducting temperature of the surface of the drying cylinder contacting with fixedly wound layers of the synthetic fabrics, whereby a uniform drying condition is ensured all over the width of the wet paper web.

The following methods can be given as a means for fixedly winding such insulating sheets around the surface of a drying cylinder at the appointed positions thereof.

The first is a method in which synthetic fabrics provided with joints are wound around the circumferential surface of a drying cylinder at the desired positions thereof, the synthetic fabrics being jointed at end portions thereof through the joints.

The second is a method in which the same synthetic fabrics, which function as insulating layers, provided with joints as used in the first method are wound around the surface of a drying cylinder at the desired positions thereof and then the joint portions are adhered to the synthetic fabrics by adhesive agents all over the width thereof and simultaneously edge portions of the synthetic fabrics are adhered to the drying cylinder spot by spot.

The third is a method in which the same synthetic fabrics as in the above described method are wound around the surface of a drying cylinder at the desired positions thereof and then edge portions of the synthetic fabrics are fixed by means of a narrow adhesive tape having a resin coated layer on the surface thereof.

The fourth is a method in which the same synthetic fabrics as in the above described method are wound around the surface of a drying cylinder at the desired positions thereof and then the synthetic fabrics is fixed by means of adhesive tapes, which are slightly wider than the synthetic fabric and have a resin coated layer on the surface thereof, all over the surface of the wound synthetic fabrics.

However, all of these methods have some disadvantages in respect of practical use. That is to say, since a paper making machine is a large-sized machine having a width of 3 to 10 m, a drying cylinder having a large diameter of 1.2 to 1.8 m, several drying cylinder being contained in one set of paper making machine, and a workfield, where synthetic fabrics functioning as insulating materials are fixedly wound around the circumferential surface of a drying cylinder, is generally disadvantageous in footing, narrow and often insufficient in lighting, it requires considerable skill and long working time to ensure the operation of fixedly winding the synthetic fabrics around the circumferential surface of the drying cylinder at the desired positions thereof. For example, in cases where insulating layers formed of synthetic fabrics are formed on the circumferential surface of a drying cylinder, it is necessary that the synthetic fabrics are cylindrically joined warp-loop joints formed at the end portions of the synthetic fabrics and inserting a thin wire through the interdigitate loops. However, since the warp-loop joints formed at the end portions of thin synthetic fabric have a small diameter and dense loops, through which a wire is inserted, and also the wire is thin, it requires considerable skill and long working time to ensure the operation of fixedly winding the synthetic fabrics around the circumferential surface of a drying cylinder at the desired positions thereof, whereby the disadvantages such as a considerably long preparatory time taken until the operation is started and the lower operating rate of a paper making machine were produced according to circumstances.

SUMMARY OF THE INVENTION

It is a principal object of the present invention to provide a novel drying cylinder for use in paper making which can eliminate the above described disadvantages found in the conventional methods of fixedly winding insulating materials around a drying cylinder.

It is another principal object of the present invention to provide a construction of a built-up insulating sheet which can be speedily, correctly and fixedly wound around the circumferential surface of a drying cylinder at the desired positions thereof.

The purpose of the present invention is a drying cylinder in which a built-up insulating sheet fixedly wound around a part of the circumferential surface of the drying cylinder in order to control the moisture profile of paper webs in the cross machine direction is composed of a fluorine resin coated sheet provided with an adhesive layer on the back thereof and an air contained synthetic fabric adhered to the fluorine resin coated sheet and having a width slightly smaller than that of the fluorine resin coated sheet, the built-up insulating sheet being adhered to the appointed position of the circumferential surface of the drying cylinder through the adhesive layer exposed on the end parts of the fluorine resin coated sheet.

PREFERRED EMBODIMENTS OF THE INVENTION

Figure 1:
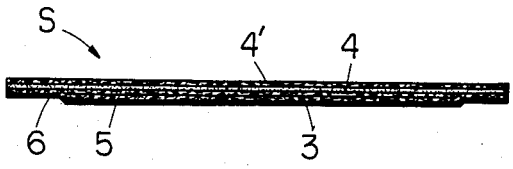
FIG. 1 is a transverse sectional view showing a built-up insulating sheet according to the present invention.
Figure 2:
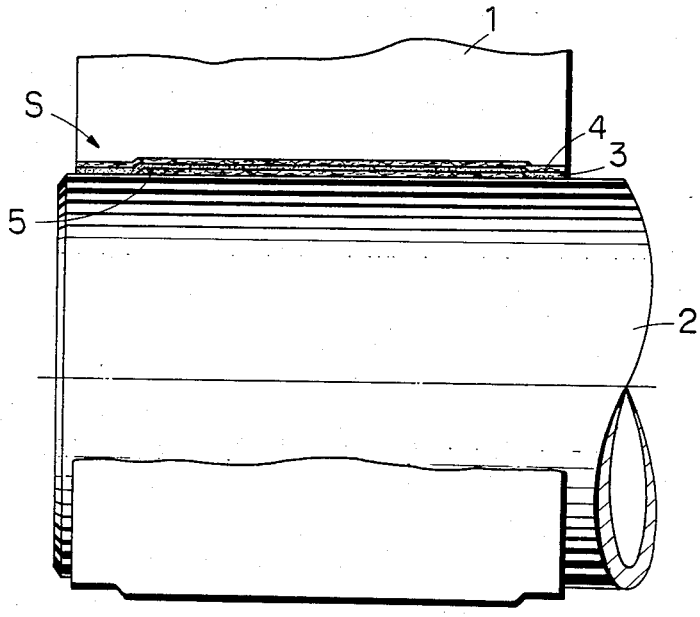
FIG. 2 is a front view showing a drying cylinder in which the condition of fixedly winding the built-up insulating sheet around the end part of the drying cylinder is shown in a slightly exaggerated manner.
Figure 3:
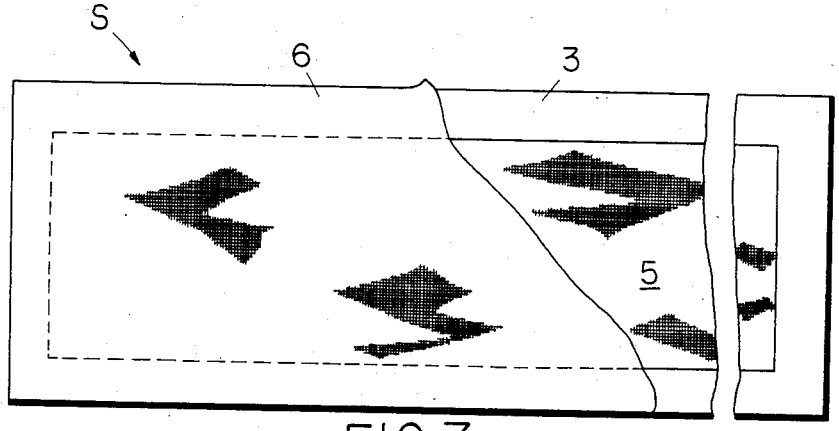
FIG. 3 is a plan view showing the built-up insulating sheet.

Referring to FIGS. 1 to 3, a built-up insulating sheet S consists of a fluorine resin coated sheet 4 having a fluorine resin coating layer 4' on the right side thereof and an adhesive agent coated layer 3 on the reverse side thereof and an air-containing synthetic fabric 5 adhered to the reverse side of the fluorine resin coated sheet 4 through said adhesive agent coated layer 3. The "air-containing synthetic fabric 5" in the present invention is a general term for woven or knit fabric made of monofilaments or multifilaments of synthetic yarns such as polyamide resin and polyester resin and non-woven cloths such as span bonded cloths. The air-containing synthetic fabric 5 can make the spaces formed in the meshes of woven fabric, knitting meshes of knit fabric and the void areas among intersecting fibers and yarns function as air-holding portions which are suitable for improving an insulating performance. The side of the air-containing synthetic fabric 5 facing to the drying cylinder 2 and the adhesive agent coated layer 3 exposed from the end portion of the air-containing synthetic fabric 5 are protected with releasing papers 6 before the built-up insulating sheet S is fixedly wound around the circumferential surface of the drying cylinder 2.

The width of the air-containing synthetic fabric 5 is slightly smaller than that of the fluorine resin coated sheet 4. As shown in FIG. 3, the air-containing synthetic fabric 5 has the adhesive agent coated layers 3 exposed by 20 to 40 mm on both sides thereof either in a longitudinal direction or in a transverse direction. These exposed portions of the adhesive agent coated layer 3 function as adhesive surfaces for fixedly adhering the built-up insulating sheet S to the surface of the drying cylinder 2, whereby the air-containing synthetic fabric 5 can be fixedly adhered to the circumferential surface of the drying cylinder 2 at the appointed positions thereof. Thus, an insulating layer having the same width as the air-containing synthetic fabric 5 is formed around the surface of the drying cylinder 2 at the desired positions thereof. In the preferred embodiment as shown in FIG. 3, the built-up insulating sheet S is shipped by manufacturers cylindrically wound but the air-containing synthetic fabric 5 and the exposed portions of the adhesive agent coated layer 3 are protected with releasing papers 6 all over the surfaces thereof. In the operation, in which the built-up insulating sheet S is mounted on the drying cylinder 2, the air-containing synthetic fabric 5 can be made to function as insulating members by separating the releasing paper 6 and fixedly winding the built-up insulating sheet S around the drying cylinder 2 by the use of the exposed portions of the adhesive agent coated layer 3. In still another preferred embodiment of the present invention, the releasing papers 6 may be arranged so as to face only to the part of an adhesive agent coated layer exposed outwardly of the end edge portion of an air-containing synthetic fabric.

Figure 4:
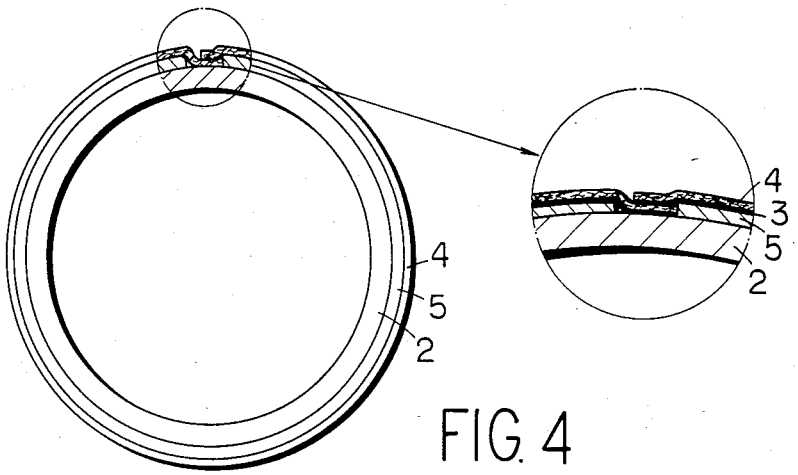
FIGS. 4 and 5 are schematic views showing the condition of the built-up insulating sheet fixedly wound.
Figure 5:
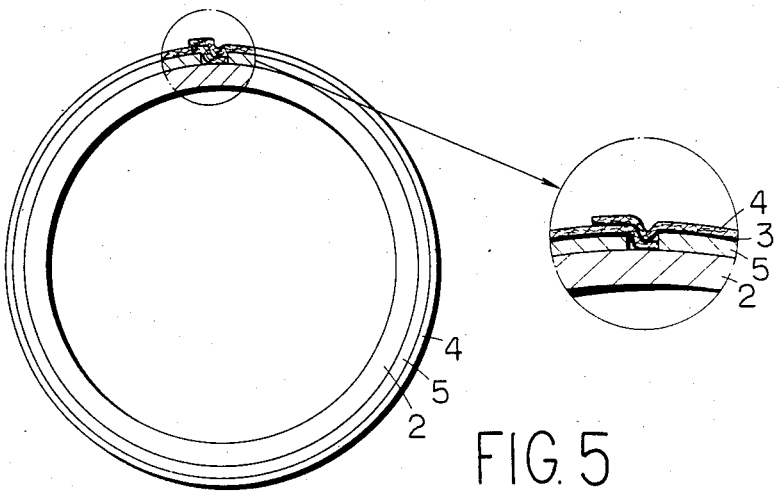

In the operation of fixedly winding a built-up insulating sheet S around a drying cylinder, the cylindrically wound built-up insulating sheet S is unwound and cut in the length slightly longer than the circumference of a drying cylinder 2, that is to say longer than the circumference of a drying cylinder by 10 to 20 mm. Then, the releasing paper 6 is separated at both end portions of the drying cylinder in the circumferential direction thereof and only the exposed end portion of an air-containing synthetic fabric 5 is in the length of about 20 to 40 mm. The air-containing synthetic fabric 5 is cut in the length shorter than the circumference of the drying cylinder 2 by about 10 to 20 mm. Under this condition, said releasing paper 6 is completely separated from the built-up insulating sheet S. The built-up insulating sheet S composed of the outer layer consisting of the fluorine resin coated sheet 4 and the inner layer consisting of the air-containing synthetic fabric 5 is wound around the drying cylinder 2 at the desired positions thereof to form strong adhesion between the built-up insulating sheet S and the drying cylinder 2 by the use of the adhesive agent coated layer 3 exposed from the end portion of the air-containing synthetic fabric 5. Thus, a little sinking portion, where the air-containing synthetic fabric 5 does not exist, is produced at a position corresponding to the seam on the surface of the drying cylinder 2 around which said built-up insulating sheet S is fixedly wound where two pieces of the fluorine resin coated sheet 4 exposed from the end portion of the air-containing synthetic fabric 5 are embedded one above the other. Accordingly, as shown in FIG. 4, an almost flat and smooth fixedly wound portion of the built-up insulating sheet S substantially having no step along the circumferential direction is formed on the surface of the drying cylinder 2. In cases where the length of a part of the fluorine resin coated sheet 4 exposed from the end portion of the air-containing synthetic fabric 5 is larger than that in the preferred embodiment as shown in FIG. 4, the fluorine resin coated sheet 4 is not embedded in a sinking portion formed between the end portions of the fabric 5, as shown in FIG. 5, but forms the fixedly wound portion having an overlapping region longer than that in the preferred embodiment as shown in FIG. 4. However, since the thickness of the fluorine resin coated sheet 4 is remarkably small to a degree of 0.11 mm also in this preferred embodiment, an almost flat and smooth fixedly wound portion of the built-up insulating sheet S substantially having no step along the circumferential direction is formed on the surface of the drying cylinder 2.

Although synthetic monofilament yarns such as polyamide resin and polyester resin are most suitable as the constituent element of the air-containing synthetic fabric 5, in cases where woven fabrics are used as the air-containing synthetic fabric 5, it is desired to adjust the density of monofilament yarns constructing fabric structures so that the diameter of warp and weft yarns may be about 0.1 to 0.3 mm and the thickness of fabric may be about 0.2 to 0.4 mm. It is desired that the meshes of the air-containing synthetic fabric 5 functioning as air-holding portions and controlling the moisture profile of paper web 1 being dried by the drying cylinder 2 have the porosity of 30 to 60% based on the whole developed area of the synthetic fabric. Although the porosity should be ensured by knitting meshes in cases where the air-containing synthetic fabric 5 is made of knit fabric and by irregular spaces formed among intersecting yarns in cases where the air-containing synthetic fabric 5 is made of non-woven cloths, the standard value of the porosity is similar to that in cases where the air-containing synthetic fabric 5 is made of woven fabric.

As obvious from the above description, since the built-up insulating sheet S used in the present invention has a remarkably small built-up thickness, a step is hardly formed along the direction of width and the circumferential direction of the drying cylinder 2 at the boundary of a part of the drying cyliner 2, around which the built-up insulating sheet S is wound, and a part of the drying cylinder 2, around which the built-up insulating sheet S is not wound, when the built-up insulating sheet S is fixedly wound around the drying cylinder 2 at the appointed positions thereof. Accordingly, since a substantially even drying surface is formed on the surface of the drying cylinder 2, the bad influence of a step portion produced when the built-up insulating sheet S is fixedly wound around the drying cylinder 2 upon the quality of paper web can be completely eliminated. Thus, the fluorine resin coating layer 4' contacting with the paper web 1 forms an even drying surface showing superior releasing property to the paper web 1 and gives air-holding portions of the air-containing synthetic fabric 5 adhered to the underside of the fluorine resin coating layer 4' the function acting as the moisture profile controlling insulating member for the paper web 1.

In addition, in the practice of the present invention, it is necessary for air-containing synthetic fabric to be subjected to thermal setting in the usual manner prior to the adherence to a fluorine resin coated sheet to prevent troubles such as creases resulting from thermal shrinkage and the like.

The synthetic fabric forming air-holding portions can be provided in a short time during the suspension of a paper making machine and the like without giving any special mechanical work or reconstruction to a drying cylinder. And, since the positions and the width of a built-up insulating sheet to be wound on the surface of a drying cylinder can be freely adjusted according to changes in temperature conditions of the drying machine and the moisture profile of a paper web without giving any special work to a dryer felt, the desired air-holding portions can be easily formed on the surface of a drying cylinder even though the kind of paper webs to be dried and paper making conditions are changed.

Further, since a moisture profile controlling built-up insulating sheet according to the present invention can be easily adhered to the desired portion of the surface of a drying cylinder by only separating a releasing paper therefrom, it can be correctly and speedily mounted on a drying cylinder in the facilities in which the operating conditions are not always good. In short, a moisture profile controlling built-up insulating sheet according to the present invention can speedily meet to the changes in the moisture profile of a wet paper web in the drying part of a paper making process whereby being capable of greatly contributing to the improvements of the final products in quality, a paper making process in productivity and an energy saving effect.

What is claimed is:

1. A drying cylinder for use in controlling the moisture profile of paper web in the cross machine direction in the drier section of a paper making machine comprising, a built-up insulating sheet fixedly wound around the circumferential surface of said drying cylinder in the surface portion where the width of said paper web where the moisture profile is controlled contacts said drying cylinder said insulation sheet being built up of a fluoride resin coated sheet having an adhesive agent coated layer on the one side thereof and a synthetic fabric sheet having air holding voids defined between intersticies of the filaments forming the fabric sheet and adhered to said fluorine resin coated sheet, said fabric sheet having a width slightly smaller than that of said fluorine resin coated sheet, said built-up insulating sheet being adhered to the circumferential surface of said drying cylinder with said fabric sheet having said air holding voids against said cylinder surface through said adhesive agent coated layer exposed at the end portion of said fluorine resin coated sheet and extending beyond the opposite longitudinal edges of said smaller width fabric sheet.

2. A drying cylinder for use in paper making as set forth in claim 1, in which said fluorine resin coated sheet is a glass fiber cloth coated with fluorine resin.

3. A drying cylinder for use in paper making as set forth in claim 1, in which said synthetic fabric sheet is formed of woven fabric made of synthetic monofilament yarns.

4. A drying cylinder for use in paper making as set forth in claim 1, in which the ratio of the area of heat insulting voids to the area of yarns of said synthetic fabric sheet and functioning as the air-holding portions to the whole developed area of said synthetic fabric sheet is 30 to 60%.

5. A drying cylinder for use in paper making as set forth in claim 1, in which said synthetic fabric sheet is a woven fabric of synthetic monofilament yarns, said fabric having warp and weft yarns with diameters of 0.1 to 0.3 mm, and a thickness of 0.2 to 0.4 mm.

* * * * *